US005190910A

United States Patent [19]

Aono

[11] Patent Number: 5,190,910

[45] Date of Patent: Mar. 2, 1993

[54] THERMAL TRANSFER IMAGE-RECEIVING MATERIAL

[75] Inventor: Toshiaki Aono, Kanagawa, Japan

[73] Assignee: Fuji Photo Film Co., Ltd., Kanagawa, Japan

[21] Appl. No.: 834,400

[22] Filed: Feb. 12, 1992

[30] Foreign Application Priority Data

Feb. 13, 1991 [JP] Japan ..... 3-40619

[51] Int. Cl.[5] ..... B41M 5/035; B41M 5/38

[52] U.S. Cl. ..... 503/227; 428/195; 428/913; 428/914

[58] Field of Search ..... 8/471; 428/195, 913, 428/914; 503/227

[56] References Cited

FOREIGN PATENT DOCUMENTS 2-106392 4/1990 Japan ..... 503/227
2-39986 9/1990 Japan ..... 503/227
2-243392 9/1990 Japan ..... 503/227

*Primary Examiner*—B. Hamilton Hess
*Attorney, Agent, or Firm*—Sughrue, Mion, Zinn, Macpeak & Seas

[57] ABSTRACT

There is disclosed a thermal transfer image-receiving material capable of providing an image having high quality and excellent stability, even at a high temperature and high humidity. In the above thermal transfer image-receiving material, the image-receiving layer contains a dispersion prepared by dispersing a dye-accepting substance in a hydrophilic binder with an emulsifier containing at least one surfactant selected from the polymers containing a repetitive unit represented by Formula (I):

(I)

wherein $R_1$ and $R_2$ may be the same or different and each represent a hydrogen atom, a halogen atom, a substituted or unsubstituted aliphatic hydrocarbon group, or an $—SO_3M$ group, in which M represents a cation capable of forming a salt with sulfonic acid; A represents —O— or —NH—; Z represents a group of carbon atoms necessary for forming a benzene ring or a naphthalene ring; $m^1$ and $m^2$ each represent 0 to 1; and $X_1$ and $X_2$ may be the same or different and each represent a hydrogen atom, a substituted or unsubstituted alkyl group, or a substituted or unsubstituted aryl group, provided that $X_1$ and $X_2$ may be combined with each other to form a 3— to 8-membered ring.

19 Claims, No Drawings

THERMAL TRANSFER IMAGE-RECEIVING MATERIAL

FIELD OF THE INVENTION

The present invention relates to a thermal transfer image-receiving material which contains a heat-migrating dye and is used in a thermal transfer method. More specifically, the present invention relates to a thermal transfer image-receiving material having excellent production aptitude and capable of providing an image having excellent aging stability and high quality.

BACKGROUND OF THE INVENTION

In recent years, various information processing systems have been developed to keep step with the rapid progress of the information industry, and recording methods and apparatuses fitted to the respective information systems have been developed and employed. Recently, a thermal transfer recording method has been used as one such recording method since the apparatus used is light and compact, does not make noise, has excellent operability and maintainability, and is easy to colorize.

This thermal transfer recording method can be classified into two large categories, that is, a thermal melting type and a heat migrating type. Various methods have been proposed for the latter method in order to obtain a transferred image with a high density by the thermal transfer recording method, but those methods experience various problems such as fading of the transferred image during storage, retransfer of a dye to surfaces of other materials, an increase in curling of the image-receiving material after transfer, and an increase in the production cost of the recording medium.

Accordingly, a method for increasing the density of a transferred image, that is, a thermal transfer image-receiving material having an image-receiving layer formed by coating a dispersion prepared by emulsifying and dispersing a dye-accepting substance (for example, a dye-accepting polymer and a thermal solvent having a high dye-solubility) in a water-soluble binder, was proposed by the present inventor in JP-A-2-106392 (the term "JP-A" as used herein means an unexamined published Japanese application), JP-A-2-239986 and JP-A-2 243392 to solve these problems.

However, it has been found that the size of dispersed substances in the above dispersion increases upon aging, and the image transferred onto the imagereceiving material is blurred at a high temperature and high humidity.

SUMMARY OF THE INVENTION

One object of the present invention is to improve the aging stability of the dispersion in which a dye-accepting substance is emulsified and dispersed in a water-soluble binder.

Another object of the present invention is to provide a thermal transfer image-receiving material which does not provide a blurred image, even when storing the image-receiving material at a high temperature and high humidity after transfer.

The above objects have been achieved by a thermal transfer image-receiving material comprising a support having provided thereon at least one image-receiving layer for accepting a dye transferred from a thermal transfer dye-providing material to form an image, wherein the image-receiving layer contains a dispersion prepared by dispersing a dye-accepting substance in a hydrophilic binder with an emulsifier comprising at least one surfactant selected from the polymers containing a repetitive unit represented by Formula (I):

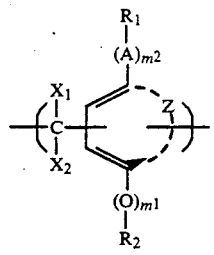

(I)

wherein $R_1$ and $R_2$ may be the same or different and each represent a hydrogen atom, a halogen atom, a substituted or unsubstituted aliphatic hydrocarbon group, or an $—SO_3M$ group, in which M represents a cation capable of forming a salt with sulfonic acid; A represents —O— or —NH—; Z represents a group of carbon atoms necessary for forming a benzene ring or a naphthalene ring; $m^1$ and $m^2$ each represent 0 or 1; and $X_1$ and $X_2$ may be the same or different and each represent a hydrogen atom, a substituted or unsubstituted alkyl group, or a substituted or unsubstituted aryl group, provided that $X_1$ and $X_2$ may be combined with each other to form a 3- to 8-membered ring.

DETAILED DESCRIPTION OF THE INVENTION

The present invention will be explained below in detail.

The thermal transfer image-receiving material contains an oil-soluble additive prepared by emulsifying and dispersing a dye-accepting substance in the presence of at least one surface active polymer selected from the polymers containing a repetitive unit represented by Formula (I). Preferably, this repetitive unit is represented by Formula (I'):

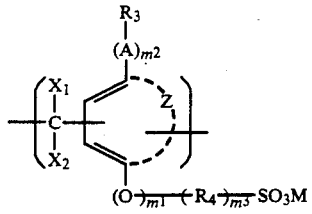

(I')

wherein $R_3$ represents a hydrogen atom or a substituted or unsubstituted aliphatic hydrocarbon group; $m^1$, $m^2$ and $m^3$ each represent 0 or 1; $R_4$ represents a divalent aliphatic hydrocarbon group, provided that this divalent group may contain an oxygen atom; and Z, A, $X_1$, $X_2$ and M are the same as Z, A, $X_1$, $X_2$ and M, respectively in Formula (I).

These repetitive units may be the same or different and are contained preferably in the surface active polymer molecule in a proportion of at least 5 mole%, particularly at least 10 mole%.

The aliphatic hydrocarbon groups represented by $R_1$, $R_2$ and $R_3$ in Formulas (I) and (I') may be linear, branched, cyclic or a mixture thereof. This aliphatic hydrocarbon group can have 1 to about 50, preferably 1 to 20 and particularly preferably 6 to 18 carbon atoms.

Specific examples thereof are an alkyl group (for example, butyl, octyl, nonyl, dodecyl, and octadecyl) and an alkenyl group (for example, cis-9-octadecenyl).

When $R_1$, $R_2$ and $R_3$ are substituted aliphatic hydrocarbon groups, the total number of carbon atoms contained therein is preferably 1 to 22, and well known substituents can be applied as the substituents therefor. For example, suitable substituents include a halogen atom (for example, chlorine and bromine); a hydroxyl group; a substituted or unsubstituted alkoxy group having 1 to about 22 carbon atoms, a substituted or unsubstituted amino group, a substituted or unsubstituted carbamoyl group, and a substituted or unsubstituted sulfamoyl group (the substituents therefor are, for example, an alkyl group and an aryl group); a cyano group; a substituted or unsubstituted aryl group (for example, a phenyl group and a phenyl group substituted with an alkylsulfonyl, arylsulfonyl or hydroxyl group); a substituted or unsubstituted aryloxy group (for example, the groups having preferably 6 to about 22 carbon atoms, such as a phenoxy group and a 4-n-butoxyphenyloxy group); a substituted or unsubstituted alkylthio group (for example, the groups having preferably 1 to about 22 carbon atoms, such as methylthio, ethylthio, n-pentylthio, n-dodecylthio, n-pentadecylthio, and 5-chloropentylthio); a substituted or unsubstituted arylthio group (for example, the groups having preferably 6 nitrophenylthio); or an $-SO_3M$ group, in which M represents the same as M in Formula (I).

In Formulas (I) and (I'), $X_1$ and $X_2$ may be the same or different and each represent a hydrogen atom, a substituted or unsubstituted alkyl group (preferably the groups having up to 12 carbon atoms, for example, methyl, ethyl, n-propyl, isopropyl, n-heptyl, 1-ethylamyl, n-undecyl, and tribromomethyl), or a substituted or unsubstituted aryl group (for example, phenyl, p-chlorophenyl, p-methoxyphenyl, m-nitrophenyl, and naphthyl). $X_1$ and $X_2$ are preferably a hydrogen atom, a substituted or unsubstituted alkyl group having 1 to 8 carbon atoms, or a phenyl group. Also, $X_1$ and $X_2$ may be combined with each other to form a 3- to 8-membered ring (for example, cyclohexyl).

Examples of the cation represented by M in Formulas (I) and (I') are a hydrogen ion, an alkali metal ion (for example, $Na^+$, $K^+$ and $Li^+$), an alkaline earth metal ion (for example, $Ca^+$ and $Ba^{2+}$), and an ammonium ion (for example, an ammonium ion and an alkylammonium ion having 1 to 4 carbon atoms).

Further, the divalent aliphatic group represented by $R_4$ in Formula (I') is preferably an alkylene group, an alkyleneoxy group, a polyalkyleneoxy group, or an alkyleneoxy-alkylene group, and the specific examples thereof are ethylene, trimethylene, octamethylene, ethyleneoxy, polyethyleneoxy, polypropyleneoxy, and ethyleneoxy-trimethylene.

The surface active polymer comprising a repetitive unit represented by Formula (I) may be a homopolymer or a copolymer. When it is a copolymer, the monomers to derive the repetitive unit may be of two or more kinds, and the copolymer can contain one or more monomer components other than the monomer to derive the repetitive unit of Formula (I) which are capable of copolymerizable therewith.

The monomer unit comprising a repetitive unit represented by Formula (I), which is derived from the monomer copolymerizable with the monomer to derive the repetitive unit of Formula (I), is, for example, a divalent unit comprising a benzene ring having a methylene group or a naphthalene ring having a methylene group, and the above benzene ring or naphthalene ring may be substituted with arbitrary substituents. Examples of these substituents are an alkyl group (this group has preferably 4 to 22 carbon atoms, for example, butyl, octyl, nonyl, dodecyl, and octadecyl), a halogen atom (for example, a chlorine atom, a bromine atom and an iodine atom), a hydroxyl group, an alkoxy group (the alkyl portion has preferably 4 to 22 carbon atoms, for example, octyloxy, hexyloxy, dodecyloxy, and β-hydroxyethoxy), and a haloalkoxy group (the alkyl portion has preferably 4 to 22 carbon atoms, for example, β-chloroethoxy and β-bromoethoxy).

Examples of the monomer unit preferably combined with the repetitive unit represented by Formula (I) are:

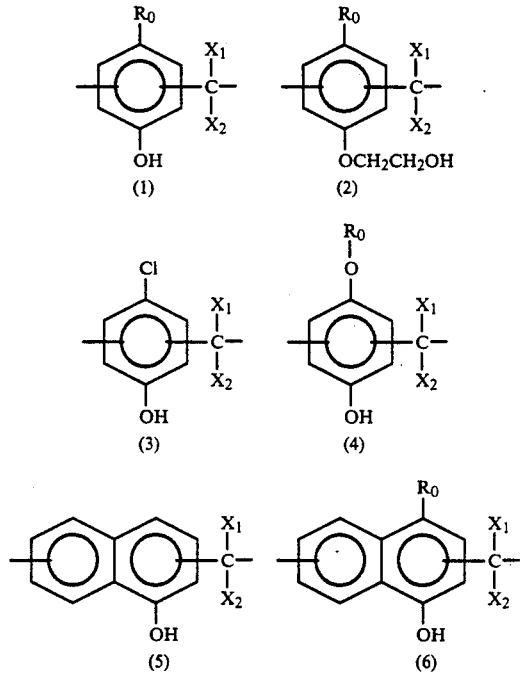

wherein $R_0$ represents a substituted or unsubstituted aliphatic hydrocarbon group having preferably 1 to 22 carbon atoms, and $X_1$ and $X_2$ have the same meaning as in Formula (I). Specific examples of $R_0$ are the same as those listed for $R_1$, $R_2$ and $R_3$.

The molecular weight of the surface active polymer used in the present invention is not specifically limited and can be about 500 to about 10,000, particularly preferably 900 to 5,000. The details on this surface active agent are described in U.S. Pat. No. 4,198,478, which is incorporated herein by reference.

Typical examples of the surface active polymer used in the present invention are shown below:

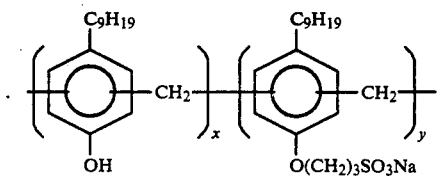

(1)

x:y = 1:1
x + y ≈ 6

-continued
(2)
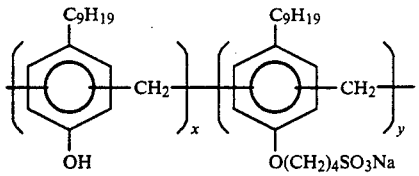
x:y = 1:4
x + y ≈ 6
(3)
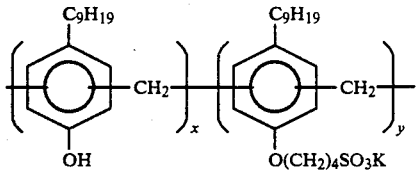
x:y = 1:9
x + y ≈ 10
(4)
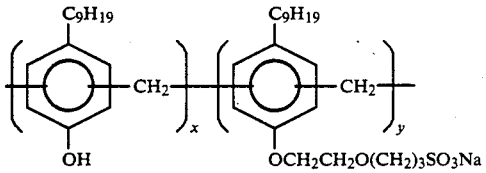
x:y = 1:1
x + y ≈ 6
(5)
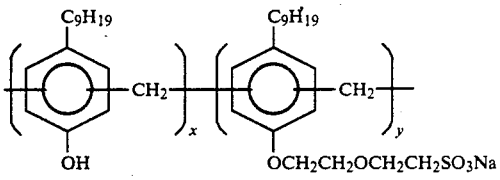
x:y = 1:4
x + y ≈ 12
(6)
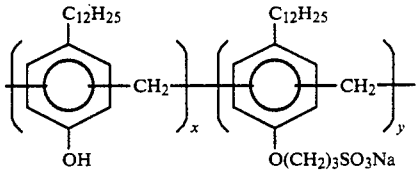
x:y = 1:9
x + y ≈ 10
(7)
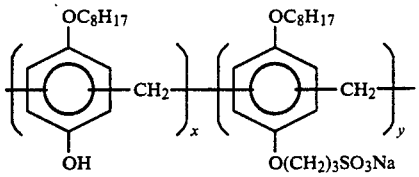
x:y = 2:3
x + y ≈ 8
(8)
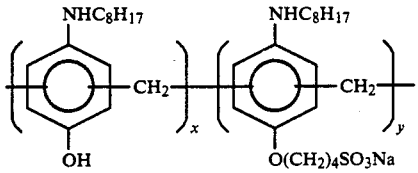
x:y = 1:1
x + y ≈ 8
-continued
(9)
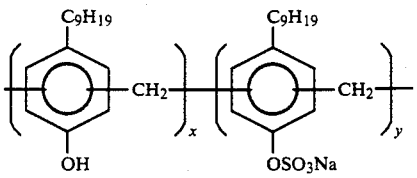
x:y = 3:2
x + y ≈ 6
(10)
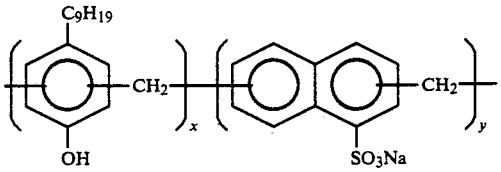
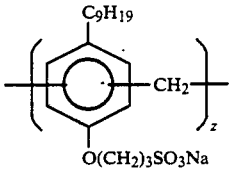
x:y:z = 4:3:3
x + y + z ≈ 7
(11)
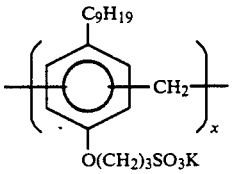
x ≈ 6
(12)
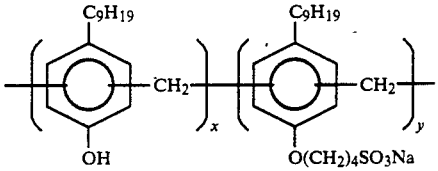
x:y = 11:9
x + y ≈ 6
(13)
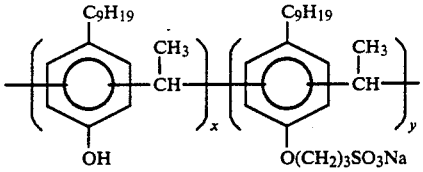
x:y = 1:4
x + y ≈ 10
(14)
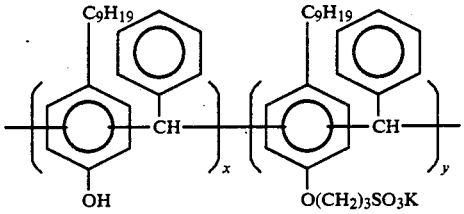
x:y = 2:9
x + y ≈ 8

-continued (15)

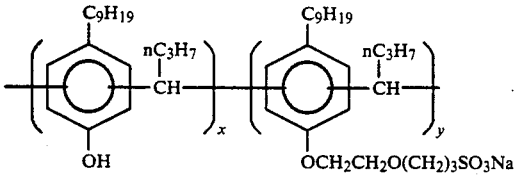

x:y = 1:2
x + y ≈ 6

(16)

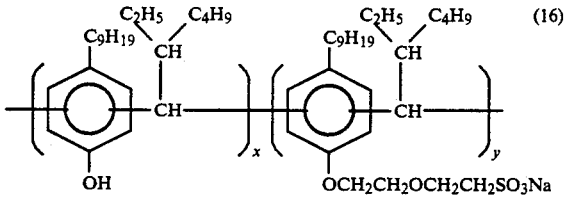

x:y = 1:4
x + y ≈ 12

(17)

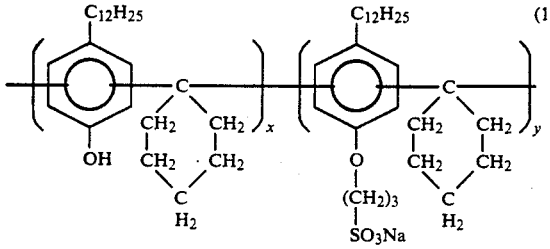

x:y = 1:9
x + y ≈ 10

(18)

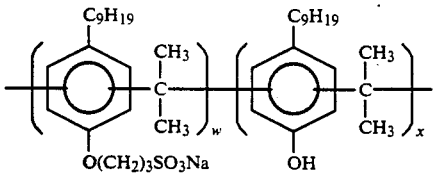

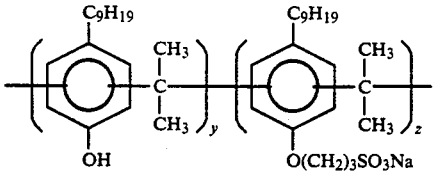

(w + z):(x + y) = 4:1
w + x + y + z ≈ 10

(19)

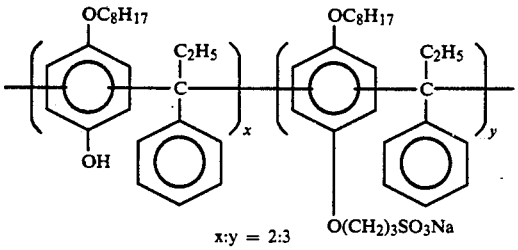

x:y = 2:3
x + y ≈ 8

-continued (20)

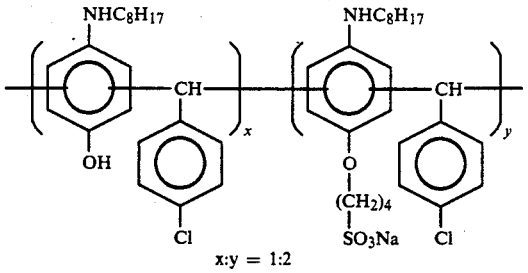

x:y = 1:2
x + y ≈ 8

(21)

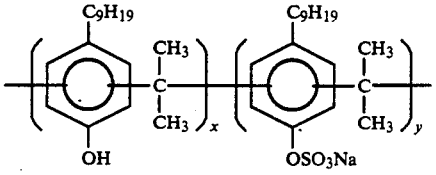

x:y = 3:2
x + y ≈ 10

(22)

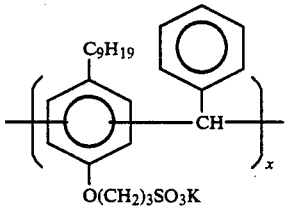

x ≈ 6

(23)

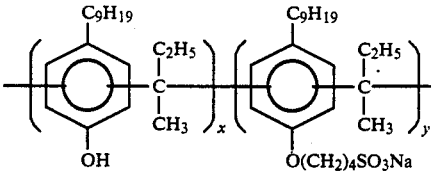

x:y = 11:9
x + y ≈ 8

The surface active polymer used in the present invention can be added to an organic solvent solution of a dye-accepting substance within the allowable solubility limit thereof. Further, this surface active polymer may be used in combination with the following surface active agents. Nonionic surface active agents shown by the following chemical structures can be used:

Pluronic:Meroxapol

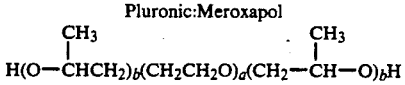

Tetronic:Poloxamine

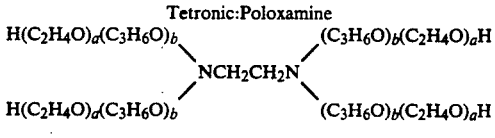

Pluradot:

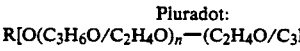

Also, anionic surface active agents having acid groups including a carboxyl group, a sulfo group, a phospho group, a sulfuric acid ester group, and a phosphoric acid group, such as alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurines, sulfosuccinic acid esters, sulfoalkylpolyoxyethylenealkylphenyl esters, and polyoxyethylenealkylphosphoric acid esters; amphoteric surface active agents such as amino acids, aminoalkylsulfonic acids, aminoalkylsulfuric acid esters, aminoalkyl phosphoric acid esters, alkylbetains, and amine oxides; and cationic surface active agents such as alkylamine salts, aliphatic or aromatic quaternary ammonium salts, heterocyclic quaternary ammonium salts including pyridium and imidazolium, aliphatic phosphonium or sulfonium salts, and phosphonium or sulfonium salts containing a heterocyclic ring can be used.

Specific examples of these surface active agents are described in U.S. Pat. Nos. 2,240,472, 2,831,766, 3,158,484, 3,068,214, 3,294,540, 3,507,660, 2,739,891, 2,823,123, 3,125,555, 3,060,156, 3,415,649, 3,666,478, 3,756,828, 3,133,816, 3,441,413, 2,868,755, 2,868,814, 2,874,151, 3,545,974, 3,726,683, 2,828,276, 3,843,368, 2,271,623, 2,828,277, 2,828,280, 2,944,900 3,253,919, 2,828,281, 2,828,823, 2,849,411, 3,589,906, and 4,198,478; British Patents 1,012,495, 722,258, 1,022,878, 1,179,290, 1,198,450, 1,397,218, 1,138,514, 1,159,825, 1,098,931, 1,059,117, 898,759, 960,029, 1,507,961, and 1,503,218; Belgian Patents 731,126 and 24,261; Dutch Patent 6,614,711; German Patents (OLS) Nos. 1,961,638 and. 1,229,729; JP-B-38-20740 (the term "JP-B" as used herein means an examined Japanese patent publication), JP-B-43-13750, JP-B-47-21811, JP-B-47-34832, and JP-B-47-34833; JP-A-50-117414, JP-A-50-59025, JP-A-53-139532, JP-A-53-21922, JP-A-55-113031, JP-A 57-108113, JP-A-57-63124, JP-A-51-124430, JP-A 51-134627, JP-A-52-54108, and JP-A-52-72381; *J. Colloid and Interface Sci.*, 37, 93 (1971); *Surface Active Agents-Physical Properties, Applications, Chemical Behaviors* (Kohdansha), p. 126, edited by Kitahara et al; *Properties and Applications of Surface Active Agents* (Saiwai Shobo), p. 167, edited by Takao Karikome; *Surface Active Agents Manual* (Sangyo Tosho), p. 565, edited by Ichiro Nishi; *Kogyo Kagaku Zasshi*, 66, 391 (1963); and *Bull. Chem. Soc. Japan*, 41, 564 (1968).

The organic solvents used for dissolving the dye-accepting substance and surface active polymer used in the present invention are, for example, low-boiling organic solvents having a boiling point of about 30° to 160° C., such as lower alkyl acetates (for example, ethyl acetate and butyl acetate), ethyl propionate, sec-butyl alcohol, methyl isobutyl ketone, cyclohexane, methyl ethyl ketone, β-ethoxyethyl acetate, and methyl cellosolve acetate. Other suitable organic solvents include those described in, for example, U.S. Pat. Nos. 2,322,027, 2,533,514, and 2,835,579; JP-B-46-23233; U.S. Pat. No. 3,287,134; British Patent 958,441; JP-A-47-1031; British Patent 1,222,753; U.S. Pat. No. 3,936,303; JP-A-51-26037; JP-A-50-82078; U.S. Pat. Nos. 2,353,262, 2,852,383, 3,554,755, 3,676,137, 3,676,142, 3,700,454, 3,748,141, and 3,837,863; German Patent (OLS) No. 2,538,889; JP-A-51-27921, JP-A-51-27922, JP-A-51-26035, JP-A-51-26036, and JP-A-50-62632; JP-B-49-29461; U.S. Pat. Nos. 3,936,303 and 3,748,141; and JP-A-53-1521.

A hydrophilic colloid capable of being used for emulsifying a dye-accepting substance is preferably a water-soluble polymer having a group capable of being subjected to a crosslinking reaction with a hardener. Particularly, gelatin is advantageously used, and the other water-soluble polymers can also be used.

Suitable water-soluble colloids include, for example, proteins such as gelatin derivatives, grafted polymers of gelatin and other polymers, albumin, and casein; cellulose derivatives such as hydroxyethyl cellulose, carboxymethyl cellulose, and cellulose sulfuric acid ester; sucrose derivatives such as sodium alginate and a starch derivative; and various synthetic hydrophilic high polymers including homo- and copolymers, such as polyvinyl alcohol, partially acetalized polyvinyl alcohol, poly-N-vinylpyrrolidone, polyacrylic acid, polymethacrylic acid, polyacrylamide, polyvinylimidazole, and polyvinylpyrazole.

Suitable types of gelatin include acid-treated gelatin and enzyme-treated gelatin described in *Bull. Soc. Sci. Phot. Japan*, No. 16, p. 30 (1966), limetreated gelatin, and hydrolysis products and enzymedecomposed products of gelatin. Suitable examples of the gelatin derivative include the products obtained by reacting gelatin with various compounds such as, for example, acid halides, acid anhydrides, isocyanates, bromoacetic acid, alkane sultones, vinylsulfonamides, maleinimide compounds, polyalkylene oxides, and epoxy compounds. Specific examples are described in U.S. Pat. Nos. 2,614,928, 3,132,945, 3,186,846, and 3,312,553, British Patents 861,414, 1,033,189, and 1,005,784, and JP-B-42-26845.

Suitable examples of the above gelatin-grafted polymer include the compounds obtained by grafting gelatin with homo- or copolymers of vinyl type monomers such as acrylic acid, methacrylic acid, derivatives thereof such as esters and amides, acrylonitrile, and styrene. Particularly preferred are polymers grafted with polymers which are compatible with gelatin to some extent, such as the polymers of acrylic acid, methacrylic acid, acrylamide, methacrylamide, and hydroxyalkyl methacrylate. Examples thereof are described in U.S. Pat. Nos. 2,763,625, 2,831,767, and 2,956,884.

Representative synthetic hydrophilic high polymers are the compounds described in German Patent (OLS) No. 2,312,708, U.S. Pat. Nos. 3,620,751 and 3,879,205, and JP-B-43-7561. These water-soluble polymers may be used individually or in combination of two or more kinds. The dye-accepting substance and water-soluble binder are used in the dye-accepting substance/water-soluble binder weight ratio of from 1 to 20, preferably from 2 to 20 and particularly preferably from 2.5 to 7.

In the present invention, depending on the kinds of the oil-soluble additives which are to be emulsified in a dispersion, the amount of the surface active polymers used is suitably 1 g or less, preferably 0.5 g or less per g of the dye-accepting substance.

The equipment for emulsifying and dispersing a dye-accepting substance suitably can exert a large shearing force or provide a very strong supersonic energy. Particularly, a colloid mill, a homogenizer, a capillary type emulsifier, a liquid siren, an electromagnetic distortion type supersonic generator, and an emulsifier with a Paulman's pipe can give good results.

An example of the method for dispersing a dye-accepting substance according to the present invention is described in detail below. The dye-accepting substance is dissolved in a low-boiling organic solvent while stirring under heating, wherein if the polymer of the invention comprising a repetitive unit represented by Formula (I) is not water-soluble, it also is dissolved therein. Next, a hydrophilic colloid solution is heated, and if the polymer comprising a repetitive unit represented by Formula (I) is water-soluble, it is added to this solution and dissolved under stirring. Then, the solution of the dye-accepting substance is added and mixed therewith, followed by dispersing and emulsifying with the above dispersing emulsifier, for example, a homogenizer.

When the other surface active agents are used in combination, they are dissolved in a low-boiling solvent or water according to the solubilities thereof.

It is also possible to remove unnecessary components, for example, low-boiling solvents and surface active agents, by noodle washing, ultrafiltration or distillation under a reduced pressure.

The support used for the thermal transfer image-receiving material of the present invention is not specifically limited, and any of the known supports can be used.

In general, examples thereof are a paper support such as a synthetic paper (synthetic papers of polyolefin and polystyrene); a woodfree paper, an art paper, a coated paper, a cast-coated paper, a wall paper, a backing paper, a synthetic resin- or emulsion-impregnated paper, a synthetic rubber latex-impregnated paper, a synthetic resin-lining paper, a board paper, a cellulose fiber paper, and a polyolefin-coated paper (in particular, a paper coated on both sides with polyethylene); and various plastic films or sheets of polyolefin, polyvinyl chloride, polyethylene terephthalate, polystyrene, polymethacrylate, and polycarbonate, and films or sheets thereof each having been subjected to processing for providing a white color reflectiveness.

Laminated materials comprising arbitrary combinations of the above materials also can be used.

The preferred support is the polyolefin-coated paper, since it has excellent whiteness, curls less than other supports, and does not tend to cause dimple deformation by heating during the thermal transfer.

The polyolefin-coated paper is described in, for example, *Shashin Kogaku No Kiso* (Volume of Silver Salt Photography) edited by The Society of Photographic Science and Technology of Japan (published by Corona Co., 1979), pp. 223 to 240. This polyolefin-coated paper comprises fundamentally a support sheet having coated thereon a polyolefin layer. The support sheet is made of materials other than synthetic resins, and woodfree paper is generally used. The polyolefin coat may be provided by any method as long as the polyolefin layer is adhered on the support. It is usually provided by an extrusion method. The polyolefin-coated layer may be provided only on the side of the support on which an image-receiving layer is provided, or it may be provided on both sides thereof. The polyolefin which may be used is high density polyethylene, low density polyethylene or polypropylene. If an adiabatic effect in thermal transfer is considered, a low density polyolefin having a low heat conductivity is preferably used on the side on which an image-receiving layer is provided.

The thickness of the polyolefin coat is not specifically limited and is usually 5 to 100 μm on one side. A thinner thickness on the image-receiving layer side is more preferable for the purpose of obtaining a higher transfer density. In order to increase whiteness, pigments such as titanium oxide and ultramarine and fillers may be added to the polyolefin coat. Further, a thin gelatin layer may be provided on the surface of the polyolefin-coated paper (on the side on which an image-receiving layer is provided and/or the side opposite thereto) in an amount of 0.05 to 0.4 g/m$^2$.

The thermal transfer image-receiving material is provided with an image-receiving layer of a dye. This image-receiving layer is preferably the layer containing singly or in combination with other binders the substance capable of accepting a thermal migrating dye migrated from the thermal transfer dye-providing material during printing and having the function of fixing the dye therein. The thickness thereof is preferably 0.5 to 50 μm.

The following resins are available as the dye-accepting polymers which are representative examples of the dye-accepting substance:

(1) Polymers having an ester bond

A polyester resin obtained by condensing a dicarboxylic acid component such as terephthalic acid, isophthalic acid and succinic acid (these dicarboxylic acid components may be substituted with a sulfone group or a carboxyl group) with ethylene glycol, diethylene glycol, propylene glycol, neopentyl glycol or bisphenol A; a polyacrylate resin and a polymethacrylate resin such as polymethyl methacrylate, polybutyl methacrylate, polymethyl acrylate and polybutyl acrylate; a polycarbonate resin; a polyvinyl acetate resin; a styreneacrylate resin; and a vinyltoluene-acrylate resin. Examples thereof are described in detail in JP-A-59-101395, JP-A-63 7971, JP-A-63-7972, JP-A-63-7973, and JP-A-60-294862. Commercially available products are Vylon 290, Vylon 200, Vylon 280, Vylon 300, Vylon 103, Vylon GK-140, and Vylon GK-130, each manufactured by Toyobo Co., Ltd., ATR-2009 and ATR-2010, each manufactured by Kao Corporation, Elitel UE3500, UE3210 and XA-8153, each manufactured by Unitika Ltd., and Polyester TP-220 and R-188, each manufactured by The Nippon Synthetic Chemical Industry Co., Ltd.

(2) Polymers having a urethane bond, such as a polyurethane resin.

(3) Polymers having an amido bond, such as a polyamide resin.

(4) Polymers having a urea bond, such as a polyurea resin.

(5) Polymers having a sulfone bond, such as a polysulfone resin.

(6) Other polymers having a highly polar bond, such as a polycaprolactone resin, a styrene-maleic anhydride resin, a polyvinyl chloride resin, and a polyacrylonitrile resin.

In addition to the above synthetic resins, mixtures of these polymers or the copolymers thereof can be used as well.

A high-boiling solvent or a thermal solvent can be incorporated into the thermal transfer image-receiving material, particularly into the image-receiving layer as the dye-accepting substance.

Examples of the high-boiling solvent are esters (for example, phthalic acid esters, phosphoric acid esters and fatty acid esters) described in JP-A-59-83154, JP-A-59-178451, JP-A-59-178452, JP-A-59-178453, JP-A-59-178454, JP-A-59-178455, and JP-A-59-178457, amides (for example, fatty acid amides and sulfonamides), ethers, alcohols, paraffins, and silicon oils.

Suitable thermal solvents include the compounds having the properties that 1) they are compatible with a dye but incompatible with a water-soluble binder, 2) they are solid at a normal temperature but are melted (may be melt mixed with other components) by heating with a thermal head during thermal transfer, and 3) they are not decomposed by heating with a thermal head. Preferred are the compounds having a melting point of preferably 35° to 250° C., particularly 35° to 200° C., and an inorganic property/organic property value of less than 1.5, wherein the inorganic property and organic property are the concept for estimating the properties of the compounds, the details of which are described in, for example, *Kagaku No Ryoiki,* 11, p. 719 (1957).

Specific examples of the high-boiling organic solvent and thermal solvent are the compounds described in JP-A-62-174754, JP-A-62-245253, JP-A-61-209444, JP-A-61-200538, JP-A-62-8145, JP-A-62-9348, JP-A-62-30247, and JP-A-62-136646.

The high-boiling organic solvent and/or thermal solvent can be used singly by finely dissolving or dispersing in an image-receiving layer or can be used mixed with a dye-accepting polymer.

Further, the above high-boiling solvent may be used for the purposes of improving the sliding property, the peeling property and the curling balance.

The above high-boiling organic solvent and/or thermal solvent can be used in any ratio to a dye-accepting polymer and is used preferably in the ratio of 1 to 100% by weight, particularly 2 to 50% by weight.

In the present invention, the above dye-accepting polymer, high-boiling organic solvent, and thermal solvent can be used as the dye-accepting substance. It is preferable to use the dye-accepting polymer, and more preferably the dye-accepting polymer and thermal solvent are used in combination. The particularly preferred dye-accepting polymer is a polyester resin.

The image-receiving layer may be composed of a single layer or two or more layers. Where two or more layers are provided, the image-receiving layer is preferably of the structure in which a synthetic resin having a lower glass transition point is used for the layer closer to the support, a high-boiling solvent and a thermal solvent are used to increase the fixability to a dye, a synthetic resin having a higher glass transition point is used for an outermost layer, and the amount of the high-boiling organic solvent and thermal solvent used is minimized or these solvents are not used at all to prevent problems such as stickiness of the surface, adherence to other materials, retransfer of a dye after transfer, and blocking with a thermal transfer dye-providing material.

The total thickness of the image-receiving layer is preferably 0.5 to 50 μm, particularly 3 to 30 μm. Where the image-receiving layer is of the two layer-structure, the thickness of the outermost layer is preferably 0.1 to 2 μm, particularly 0.2 to 1 μm.

In the present invention, the thermal transfer image receiving material may have an interlayer provided between the support and an image-receiving layer.

The interlayer functions as at least one of a cushion layer, a porous layer and a dye diffusion-preventing layer, and in certain occasions, it also functions as an adhesive.

The cushion layer has the function of thoroughly adhering the dye-providing material to the image-receiving material to prevent the transfer unevenness of the image during the thermal transfer.

The dye diffusion-preventing layer has the function, in particular, of preventing the heat migrating dye from diffusion to the support. The binder constituting this diffusion-preventing layer may be either water-soluble or organic solvent-soluble. A water-soluble binder is preferable, and examples thereof are the same as those listed for the binders for the image-receiving layer. Of these binders, gelatin is particularly preferable.

The porous layer has the function of preventing the heat applied in thermal transfer from diffusion to the support to efficiently utilize the applied heat.

The interlayer may be provided on both sides of the support when the image-receiving layers are provided on the both sides, or it may be provided only on one side thereof.

The thickness of the interlayer is preferably 0.5 to 50 μm, particularly 1 to 20 μm.

In the present invention, an image-receiving layer, a cushion layer, a porous layer, a diffusion-preventing layer and an adhesive layer forming the thermal transfer image-receiving material may contain fine powders such as silica, clay, talc, diatomaceous earth, calcium carbonate, calcium sulfate, barium sulfate, aluminum silicate, synthetic zeolite, zinc oxide, lithopone, titanium oxide, and alumina.

A fluorescent whitening agent may be used in the thermal transfer image-receiving material. Examples thereof are the compounds described in *The Chemistry of Synthetic Dyes,* edited by K. Veenkataraman, Vol. 5, Chapter 8 and JP-A-61-143752. Specific examples are a stilbene compound, a coumarin compound, a biphenyl compound, a benzoxazolyl compound, a naphthalimide compound, a pyrazoline compound, a carbostyryl compound, and a 2,5-dibenzoxazolethiophene compound.

The fluorescent whitening agent can be used in combination with an anti-fading agent.

The thermal transfer dye-providing materials used in the present invention are of two types; one is the thermal transfer dye-providing material having a layer containing a heat-migrating dye, in which a dye patternwise migrates onto the image-receiving layer of the thermal transfer image-receiving material by applying heat for recording; and the other is the thermal transfer dye-providing material having a hot-melt ink layer on a support, in which the above ink is patternwise melted by applying heat and migrates to the thermal transfer image-receiving material for recording.

Any of the conventional materials can be used for the support in the thermal transfer dye-providing material of the present invention. Examples thereof are polyethylene terephthalate, polyamide, polycarbonate, glassine paper, condenser paper, cellulose ester, fluorinated polymer, polyether, polyacetal, polyolefin, polyimide, polyphenylene sulfide, polypropylene, polysulfone, and cellophane.

The thickness of the support for the thermal transfer dyeproviding material is generally 2 to 30 μm. A subbing layer may be provided if necessary.

A dye diffusion-preventing layer comprising a hydrophilic polymer may be provided between the support and the dye-providing layer. This contributes to further increasing the transfer density. The above water-soluble polymers can be used as the hydrophilic polymer.

Further, a slipping layer may be provided in order to prevent a thermal head from sticking to the dye-providing material. This slipping layer comprises a lubricant substance which may contain a polymer binder, for example, a surface active agent, a solid or liquid lubricant, or a mixture thereof.

The thermal transfer dye-providing material containing a heat-migrating dye comprises basically a support having provided thereon a dye-providing layer containing a dye which becomes mobile by heating and a binder. This thermal transfer dye-providing material can be prepared by applying a coating solution on one side of a conventional support for the thermal transfer dye-providing material in the amount which gives a dry thickness of, for example, about 0.2 to 5 μm, preferably 0.4 to 2 μm, to thereby form a dye-providing layer, wherein the coating solution is prepared by dissolving or dispersing a conventional dye which sublimes or becomes mobile by heating and a binder in an appropriate solvent.

The dye-providing layer ma be of a single layer structure, or it may be of a structure of two or more layers so that the thermal transfer dye-providing material can be applied in a manner in which it is used many times, wherein the respective layers may have the different dye contents and dye/binder ratios.

Any dyes which are conventionally used for the thermal transfer dye-providing material can be used as the dye useful for forming such a dye-providing layer. Of these dyes, the dyes having a molecular weight as small as about 150 to 800 are particularly preferred in the present invention and are selected in view of the transfer temperature, hue, light fastness, and solubility and dispersibility in an ink and a binder resin.

Examples thereof are a dispersion dye, a basic dye and an oil-soluble dye. Of these dyes, Sumikaron Yellow E4GL, Dianix Yellow H2G-FS, Miketon Polyester Yellow 3GSL, Kayaset Yellow 937, Sumikaron Red EFBL, Dianix Red ACE, Miketon Polyester Red FB, Kayaset Red 126, Miketon Fast Brilliant Blue B, and Kayaset Blue 136 are preferred.

Further, the yellow dye represented by Formula (Y) is preferably used:

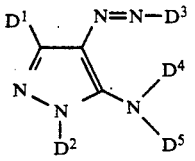

(Y)

wherein $D^1$ represents a hydrogen atom, an alkyl group, an alkoxy group, an aryl group, an alkoxycarbonyl group, a cyano group, or a carbamoyl group; $D^2$ represents a hydrogen atom, an alkyl group, or an aryl group; $D^3$ represents an aryl group or a heterocyclic group; $D^4$ and $D^5$ each represent a hydrogen atom or an alkyl group; and each of the above groups may be substituted.

Examples thereof are shown below:

Y-1

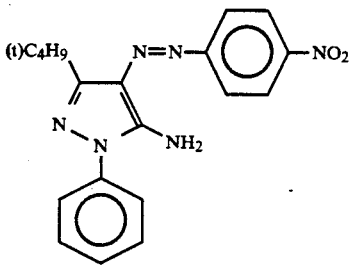

-continued

Y-2

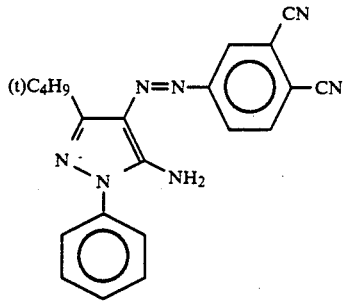

Y-3

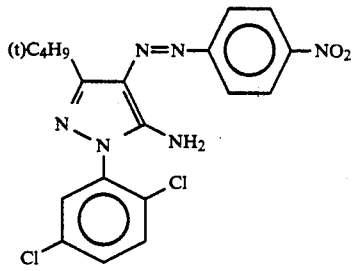

Y-4

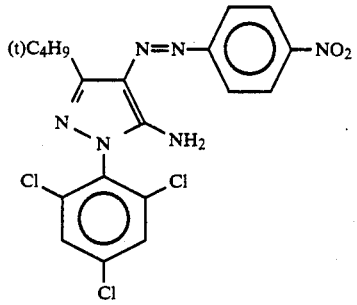

Y-5

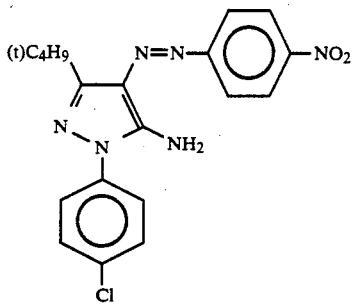

Y-6

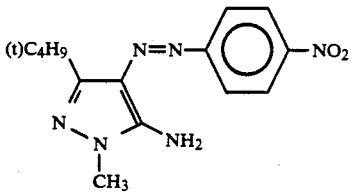

Y-7

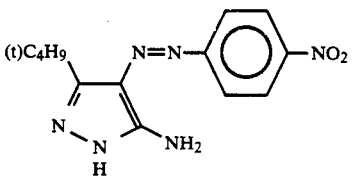

-continued

Y-8

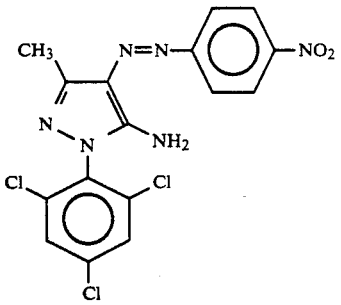

Y-9

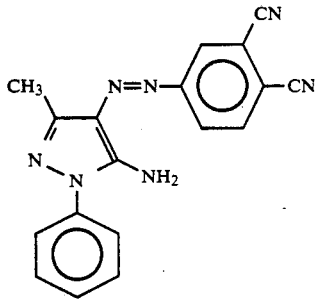

Y-10

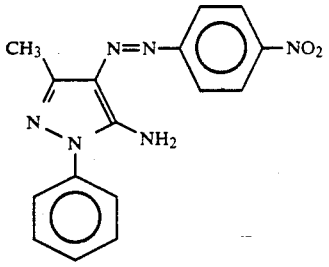

-continued

Y-11

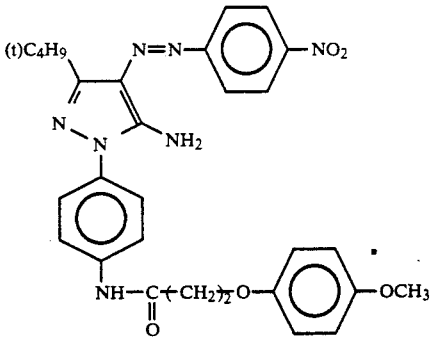

The magenta dye represented by Formula (M) is preferably used:

(M)

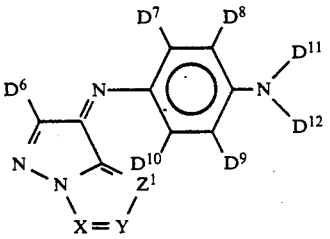

wherein $D^6$ to $D^{10}$ each represent a hydrogen atom, a halogen atom, an alkyl group, an alkoxy group, an aryl group, an aryloxy group, a cyano group, an acylamino group, a sulfonylamino group, a ureido group, an alkoxycarbonylamino group, an alkylthio group, an arylthio group, an alkoxycarbonyl group, a carbamoyl group, a sulfamoyl group, a sulfonyl group, an acyl group, or an amino group; $D^{11}$ and $D^{12}$ each represent a hydrogen atom, an alkyl group, or an aryl group, provided that $D^{11}$ and $D^{12}$ may be combined with each other to form a ring and that $D^8$ and $D^{11}$ and/or $D^9$ and $D^{12}$ may be combined with each other to form a ring; X, Y and $Z^1$ each represent a nitrogen atom or $=C(D^{13})-$, in which $D^{13}$ represents a hydrogen atom, an alkyl group, an aryl group, an alkoxy group, an aryloxy group, or an amino group, provided that when X and Y or Y and $Z^1$ are $=C(D^{13})-$, the two $D^{13}$ groups may be combined with each other to form a saturated or unsaturated hydrocarbon ring; and each of the above groups may be substituted.

Examples thereof are shown below:

M-1

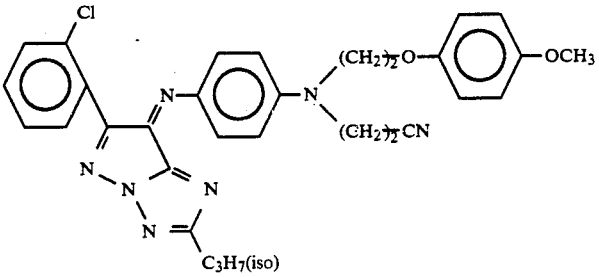

-continued
M-2
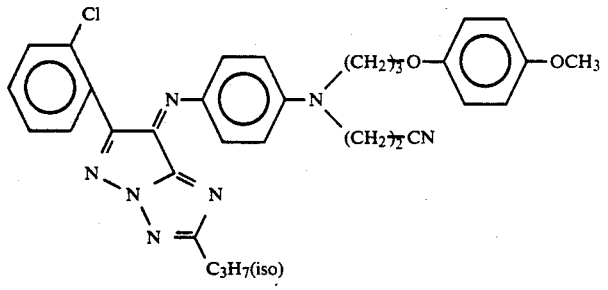
M-3
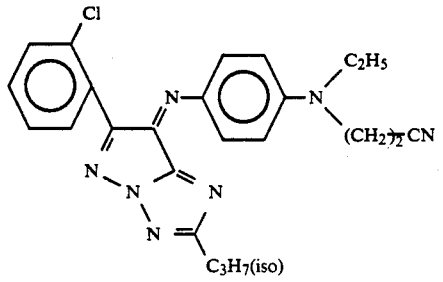
M-4
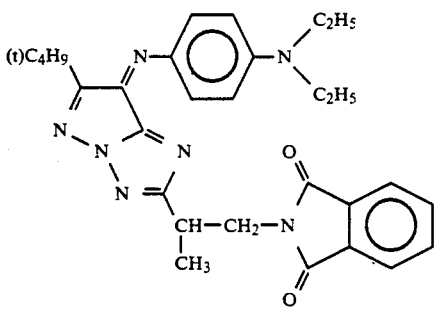
M-5
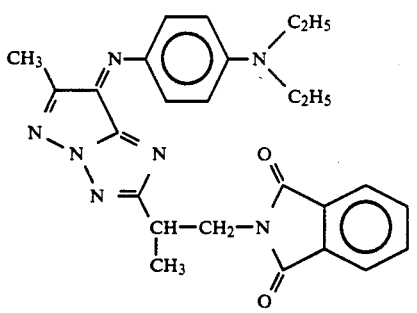
M-6
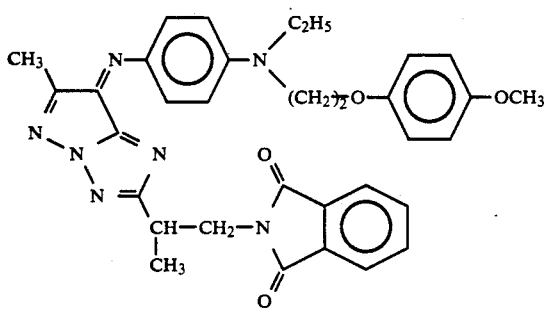

-continued
M-7
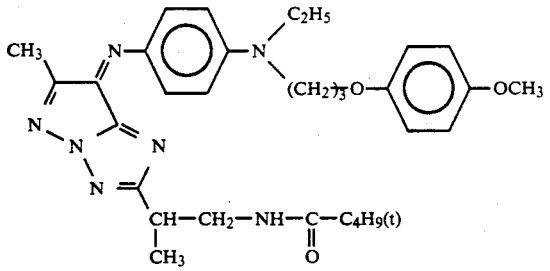
M-8
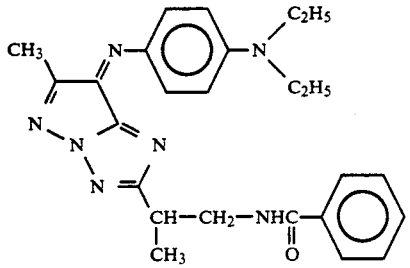
M-9
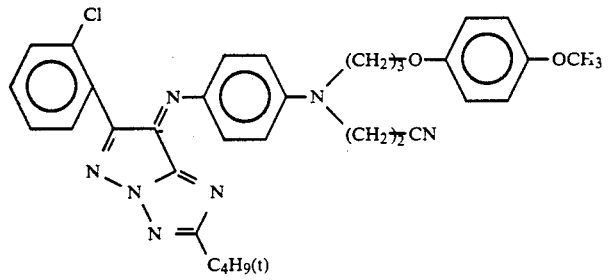
M-10
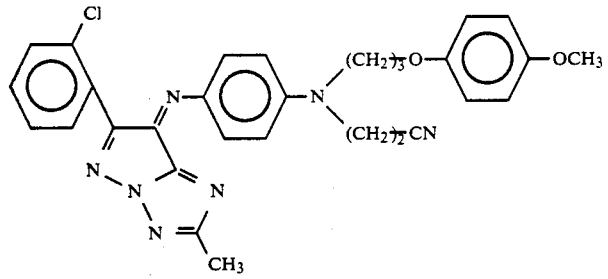
The cyan dye represented by Formula (C) is preferably used:
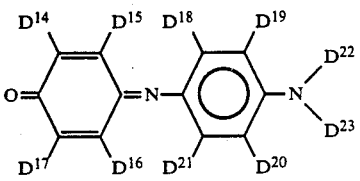
(C)
wherein $D^{14}$ to $D^{21}$ each have the same meaning as $D^6$ to $D^{10}$ defined above: and $D^{22}$ and $D^{23}$ each have the same meaning as $D^{11}$ and $D^{12}$ defined above.
Examples thereof are shown below:

C-1

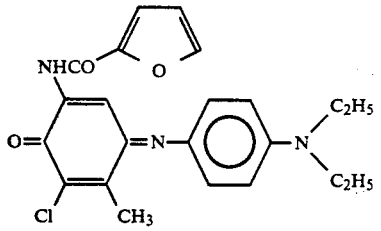

C-2

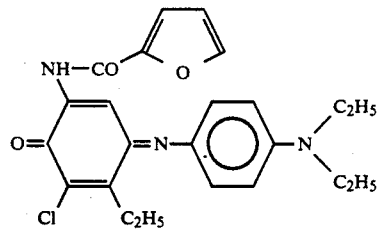

C-3

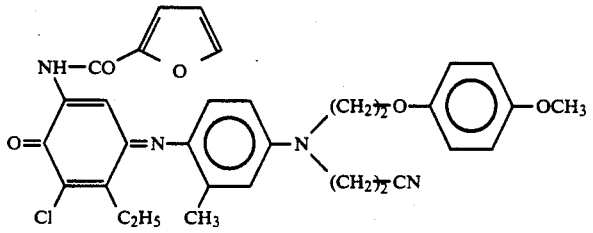

C-4

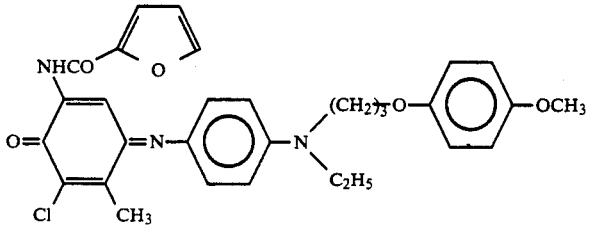

C-5

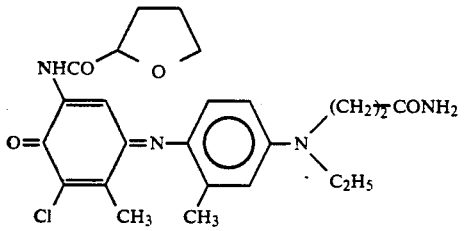

C-6

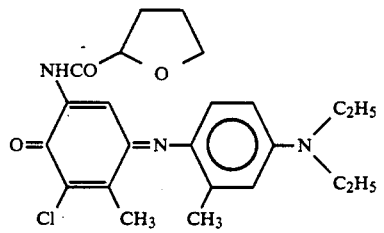

C-7

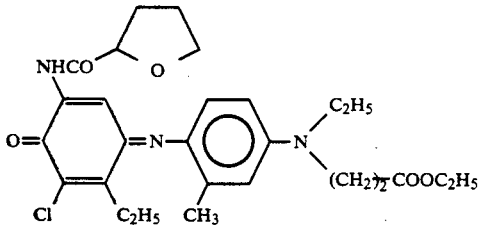

C-8

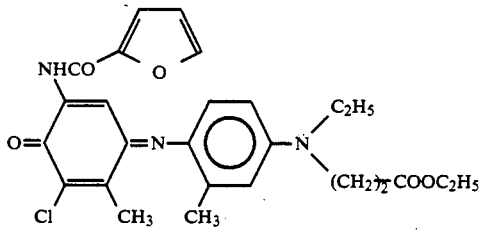

C-9

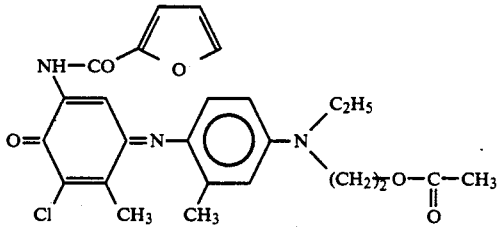

The compounds represented by above Formulas (Y), (M) and (C) into which an anti-fading group described in European Patent 423,796A is introduced are preferable because light fastness can be improved.

Any conventional binder resins known to be useful for such a purpose as that of the present invention can be used in combination with the above dyes. Usually, the binder resins which have a high heat resistance and in addition do not prevent the dyes from transfer during heating are selected. Examples of the resins used in the present invention are a polyamide resin, a polyester resin, an epoxy resin, a polyurethane resin, a polyacrylic resin (for example, polymethyl methacrylate, polyacrylamide, and polystyrene-2-acrylonitrile), a vinyl resin including polyvinylpyrrolidone, a polyvinyl chloride resin (for example, a vinyl chloride-vinyl acetate copolymer), a polycarbonate resin, polystyrene, polyphenylene oxide, a cellulose resin (for example, methyl cellulose, ethyl cellulose, carboxymethyl cellulose, cellulose acetate biphthalate, cellulose acetate, cellulose acetate propionate, cellulose acetate butyrate, and cellulose triacetate), a polyvinyl alcohol resin (for example, polyvinyl alcohol and a partially saponified polyvinyl alcohol such as polyvinyl butyral), a petroleum resin, a rosin derivative, a cumarone-indene resin, a terpene resin, and a polyolefin resin (for example, polyethylene and polypropylene).

These binder resins are used preferably in a ratio of about 80 to 600 parts by weight per 100 parts by weight of a dye.

In the present invention, the conventional ink solvents can be arbitrarily used as the ink solvent for dissolving or dispersing the above dyes. Specific examples thereof are alcohols such as methanol, ethanol, isopropyl alcohol, butanol, and isobutanol; ketones such as methyl ethyl ketone, methyl isobutyl ketone, and cyclohexanone; aromatics such as toluene and xylene; halides such as dichloromethane and trichloromethane; dioxane; tetrahydrofuran; and mixtures thereof. It is important to selectively use these solvents so as to dissolve or disperse a dye used in a higher concentration than the prescribed level and fully dissolve or disperse a binder resin. For example, the solvents are used in the amounts of about 9 to 20 times the total weight of the dye and binder resin.

In the present invention, in order to improve the releasing property of the thermal transfer dye-providing material from the thermal transfer image-receiving material, a releasing agent is incorporated preferably into the layers constituting the dye-providing material and/or the image-receiving material, particularly preferably into the outermost layers where the materials are in contact with each other.

The releasing agent can be any of the conventional ones, such as solid or wax substances including polyethylene wax, amide wax and a Teflon powder; fluorine type and. phosphate type surfactants; and paraffin type, silicone type and fluorine type oils. Of these releasing agents, a silicone oil is particularly preferred.

The silicone oil can be a modified silicone oil such as a carboxy-modified silicone oil, an amino-modified silicone oil, and an epoxy-modified silicone oil, in addition to the non-modified silicone oils. Examples thereof are various modified silicone oils described on pages 6 to 18 B of the technical document *Modified Silicone Oils,* published by Shin-Etsu Silicone Co., Ltd. Where the silicone oils are used in an organic solvent type binder, an amino-modified silicone oil having a group capable of reacting with a crosslinking agent of this binder (for example, a group capable of reacting with isocyanate) is effective; and where the silicone oils are used for emulsifying and dispersing in a water soluble binder, a carboxy-modified silicone oil (for example, X-22-3710, a trade name manufactured by Shin-Etsu Silicone Co., Ltd.) is effective.

The layers constituting the thermal transfer dye-providing material and the thermal transfer image-receiving material used in the present invention may be hardened with a hardener.

Where an organic solvent type polymer is hardened, the hardeners described in JP-A-61-199997 and JP-A-58-215398 can be used. In particular an isocyanate type hardener is preferably used for a polyester resin.

In hardening a water-soluble polymer, the hardeners described in column 41 of U.S. Pat. No. 4,678,739, JP-A-59-116655, JP-A-62-245261, and JP-A-61-18942 can be suitably used. More specifically, suitable hardeners include an aldehyde type hardener (e.g., formaldehyde), an aziridine type hardener, an epoxy type hardener, a vinylsulfone type hardener (e.g., N,N'-ethylenebis(-vinylsulfonylacetamido)ethane), an N-methylol type hardener (e.g., dimethylolurea), and a polymer hardener (e.g., the compounds described in JP-A-62-234157).

An anti-fading agent may be used for the thermal transfer dye-providing material and the thermal transfer image-receiving material. Examples of the anti-fading agent are an antioxidant, a UV absorber and a metal complex.

Examples of the antioxidant are a chroman type compound, a coumaran type compound, a phenol type compound (e.g., hindered phenols), a hydroquinone derivative, a hindered amine derivative, and a spiroindane type compound. Further, the compounds described in JP-A-61-159644 are effective as well.

Examples of the UV absorber are a benzotriazole type compound (U.S. Pat. No. 3,533,794), a 4-thiazolidone type compound (U.S. Pat. No. 3,352,681), a benzophenone type compound (JP-A-56-2784), and the compounds described in JP-A-54-48535, JP-A-62-136641 and JP-A-61-88256. Further, the UV absorptive polymer described in JP-A-62-260152 is also effective.

Examples of the metal complex are the compounds described in U.S. Pat. Nos. 4,241,155, 4,245,018 (columns 3 to 36), and 4,254,195 (columns 3 to 8), and JP-A-62-174741, JP-A-61-88256 (pages 27 to 29), JP-A-1-75568, JP-A-63-199248 and JP-A-1-74272.

Other examples of useful anti-fading agents are described in JP-A-62-215272 (pages 125 to 137).

The anti-fading agent used for preventing fading of a dye transferred to an image-receiving material may be incorporated in advance into the image-receiving material or may be supplied to the image-receiving material from the outside by a method such as transfer from the dye-providing material.

The above antioxidant, UV absorber and metal complex may be used in combination with each other.

Various surfactants can be used in the component layers of the thermal transfer dye-providing material and the thermal transfer image-receiving material as a coating aid, for improvement of the peeling property and the sliding property, for anti-electrification and for the promotion of development.

Suitable surfactants include a nonionic surfactant, an anionic surfactant, an amphoteric surfactant and a cationic surfactant. Specific examples thereof are described in JP-A-62-173463 and JP-A-62-183457.

Further, in dispersing a substance capable of accepting a heat migrating dye, a releasing agent, an anti-fading agent, a UV absorber, a fluorescent whitening agent, and other hydrophobic compounds in a water-soluble binder, a surfactant is preferably used as a dispersion aid. For this purpose, the surfactants described in JP-A-59-157636 (pages 37 to 38) are particularly preferably used in addition to the above surfactants.

Organic fluorinated compounds may be incorporated into the component layers of the thermal transfer dye-providing material and the thermal transfer image-receiving material for the purposes of enhancing the sliding property, anti-electrification and peeling property. Typical examples of the organic fluorinated compounds are fluorinated surface active agents, oily fluorinated compounds such as fluorinated oil, and hydrophobic fluorinated compounds such as solid fluorinated resins including a tetrafluoroethylene resin.

A matting agent can be used for the thermal transfer dye-providing material and the thermal transfer image-receiving material. Examples of the matting agent are the compounds described in JP-A-63-274944 and JP-A-63-274952, such as benzoguanamine resin beads, polycarbonate resin beads and AS resin beads, in addition to the compounds described in JP-A-61-88256 (page 29), such as silicon dioxide, polyolefin and polymethacrylate.

In the present invention, the thermal transfer dye-providing material is superposed on the thermal transfer image-receiving material, and thermal energy corresponding to an image information is applied from either side thereof, preferably from the back of the thermal transfer dye-providing material, with a heating means, for example, a thermal head, to enable the dye of the dye-providing layer to transfer to the thermal transfer image-receiving material according to the amount of the applied heat energy, whereby a color image having a gradation with excellent sharpness and resolution can be obtained.

The heating means is not limited to the thermal head, and well known means such as a laser (for example, a semiconductor laser), infrared flash and heat pen can be used.

In the present invention, the thermal transfer dye-providing material is combined with the thermal transfer image-receiving material to be applied to printing with various printers of a thermal printing system, facsimile, print making of an image with a magnetic recording system, a magneto-optical recording system, and an optical recording system, a television, and print making from a CRT picture.

The details of the thermal transfer recording method can be found in JP-A-60-34895.

The dye-providing material is preferably subjected to an anti-sticking treatment on the side of the support on which no dye-providing layer is provided in order to prevent the material from sticking to a thermal head for printing during heating and to improve sliding.

For example, a heat-resistant slipping layer is provided preferably comprising primarily 1) a reaction product of a polyvinyl butyral resin and isocyanate, 2) an alkali metal salt or alkaline earth metal salt of phosphoric acid ester, and 3) a filler. The polyvinyl butyral resin preferably has a molecular weight of about 60,000 to 200,000, a glass transition point of 80° to 110° C., and a vinyl butyral portion of 15 to 40 weight % in order to have more reaction sites with isocyanate. Gafac RD720, manufactured by Toho Chemical Industry Co., Ltd., is used as the alkali metal salt or alkaline earth metal salt of phosphoric acid ester in the amount of about 1 to 50 weight %, preferably 10 to 40 weight % based on the amount of the polyvinyl butyral resin.

The dye-providing material may be provided with a hydrophilic barrier layer in order to prevent the dyes from diffusion toward the support. The hydrophilic dyebarrier layer contains a hydrophilic compound useful for the intended purpose. In general, the excellent results can be obtained with gelatin, polyacrylamide, polyisopropylacrylamide, butyl methacrylate-grafted gelatin, ethyl methacrylate-grafted gelatin, cellulose monoacetate, methyl cellulose, polyvinyl alcohol, polyethyleneimine, polyacrylic acid, a mixture of polyvinyl alcohol and polyvinyl acetate, a mixture of polyvinyl alcohol and polyacrylic acid, and a mixture of cellulose monoacetate and polyacrylic acid. Of these hydrophilic compounds, polyacrylic acid, cellulose monoacetate and polyvinyl alcohol are particularly preferred.

The dye-providing material may be provided with a subbing layer. In the present invention, any materials for the subbing layer may be used as long as they can act as prescribed. Preferred examples thereof are a copolymer of acrylonitrile, vinylidene chloride and acrylic acid (14:80:6 by weight), a copolymer of butyl acrylate, 2-aminoethyl methacrylate and 2-hydroxyethyl methacrylate (30:20:50 by weight), a linear, saturated polyester, for example, Bostik 7650, manufactured by Emhart Co., Bostik Chemical group, and a chlorinated high-density polyethylene-trichloroethylene resin. The coated amount of the subbing layer is not specifically limited, but usually it is 0.1 to 2.0 g/m$^2$.

In the dye-providing layer, the dye is selected so that the transfer can be carried out at a prescribed hue in printing, and if necessary, two or more dye-providing layers each containing a different dye may be formed in order on the thermal transfer dye-providing material. For example, where the printing of each color is repeated according to the signals of the separated colors to form an image like a color photograph, the hue of the printed image comprises preferably cyan, magenta and yellow colors, and three dye-providing layers containing the dyes capable of giving such hues are provided. In addition to cyan, magenta and yellow, a dye-providing layer containing a dye capable of giving a black hue may be added. In forming these dye-providing layers, it is preferable to provide marks for detecting a position at the same of the formation of any of the dye-providing layers, because the use of ink and printing step separate from the formation of the dye-providing layers becomes unnecessary.

The present invention will be explained further by reference to the following examples, which are not to be construed as limiting the present invention in any way. All parts, percents, ratios and the like are by weight unless indicated otherwise.

EXAMPLE 1

The inks for forming the dye-providing layers having the following compositions were coated on a 6 μm thick support of a polyester film manufactured by Teijin Limited so that the coated amount thereof after drying became 1.2 g/m$^2$, to thereby obtain the dye-providing materials (C-a, M-a and Y-a), wherein the support was provided on one side thereof with a heat-resistant sliding layer comprising a thermosetting acrylic resin.

| Composition of the dye-providing layer-forming cyan ink | |
|---|---|
| Dye-a | 3 parts |
| Polyvinyl butyral resin (Denka Butyral 5000A, manufactured by Denki Kagaku Kogyo K. K.) | 2.5 parts |
| Polyisocyanate (Takenate D110N, manufactured by Takeda Chemical Industries, Ltd.) | 0.1 part |
| Amino-modified silicone oil (KF-857, manufactured by Shin-Etsu Chemical Co., Ltd.) | 0.004 part |
| Methyl ethyl keton | 50 parts |
| Toluene | 50 parts |
| Dye-a | |

-continued

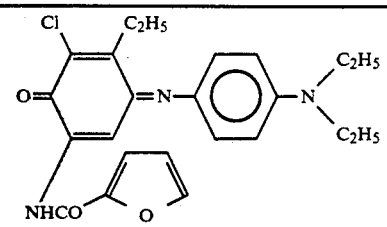

Composition of the dye-providing layer-forming magenta ink

| | |
|---|---|
| Dye-b | 2.5 parts |
| Polyvinyl butyral resin (S-Lec BX-1, manufactured by Sekisui Chemical Co., Ltd.) | 2.5 parts |
| Polyisocyanate (KP-90, manufactured by Dainippon Ink and Chemicals, Inc.) | 0.1 part |
| Silicone oil (KF-857, manufactured by Shin-Etsu Chemical Co., Ltd.) | 0.004 part |
| Methyl ethyl ketone | 70 parts |
| Toluene | 30 parts |

Dye-b

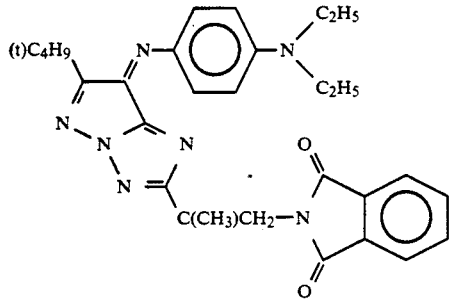

Composition of the dye-providing layer-forming yellow ink

| | |
|---|---|
| Dye-c | 5 parts |
| Ethyl cellulose | 3 parts |
| Methyl ethyl ketone | 50 parts |
| Toluene | 50 parts |

Dye-c

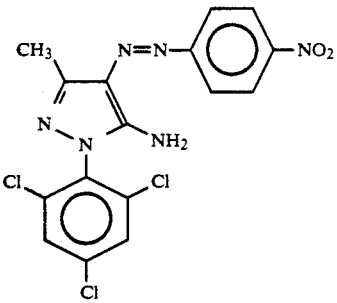

Next, the thermal transfer image-receiving material was prepared as follows:

| | |
|---|---|
| 1st layer: | |
| Gelatin (10 weight % aqueous solution) | 100 g |
| Water | 40 ml |
| Hardener (4 weight % aqueous solution) [1,2-bis(vinylsulfonyl-acetamido)ethane] | 60 ml |
| 2nd layer: | |
| Dye-accepting polymer emulsion A | 100 g |
| Water | 50 ml |
| 3rd layer (outermost layer): | |
| Dye-accepting polymer emulsion B | 100 g |
| Water | 50 ml |
| Fluorinated surface active agent (1)* | 5 ml |
| Fluorinated solid fine particle (1)* dispersion (solids content: 20%) | 2 g |

Fluorinated surface active agent (1)*:

$C_8F_{17}SO_2N(C_3H_7)CH_2COOK$

Fluorinated solid fine particle (1)*:

20 g of the fluorinated solid fine particle (1)* was prepared by dispensing 1 g of the fluorinated surface active agent (1)* in a solution in which 2 g of gelatin was dissolved in 78 ml of water with a homogenizer at 10,000 rpm for 5 minutes (in case of the dispersion, the amount thereof is corresponding to 20 g of the solid, provided that the above amount of water (78 ml) used for dissolving gelatin is reduced so that the total amount becomes 100 g).

The above dye-accepting polymer emulsions A and B were prepared as follows:

PREPARATION OF THE DYE-ACCEPTING POLYMER EMULSION A

| | |
|---|---|
| Solution IA composition: | |
| Gelatin (10% aqueous solution) | 100 g |
| Sodium dodecylbenzenesulfonate (5% aqueous solution) | 25 ml |
| Water | 50 ml |
| Solution IIA composition: | |
| Polyester resin (1)* | 30 g |
| Toluene | 60 g |
| Methyl ethyl ketone | 60 g |
| Dicyclohexyl phthalate | 4.5 g |
| Diphenyl phthalate | 4.5 g |
| Polymer (5) | 3 g |

After solution IIA was prepared, it was added to Solution IA under stirring, and the mixture was emulsified and dispersed with a homogenizer at 15,000 rpm for 9 minutes to thereby prepare the dye-accepting polymer emulsion A.

| Above polyester resin (1)*: | (parts by weight) |
|---|---|
| Polyester TP-220, manufactured by The Nippon Synthetic Chemical Industry Co., Ltd. | 1 |
| Kemit R-188, manufactured by Toray Industries, Inc. | 1 |
| Kemit K-1294, manufactured by Toray Industries, Inc. | 1 |
| S-Lec BLS, manufactured by Sekisui Chemical Co., Ltd. | 1 |

PREPARATION OF THE DYE-ACCEPTING POLYMER EMULSION B

| | |
|---|---|
| Solution IB composition: | |
| Gelatin (10% aqueous solution) | 100 g |
| Sodium dodecylbenzenesulfonate (5% aqueous solution) | 25 ml |
| Water | 50 ml |
| Solution IIB composition: | |
| Polyester resin (1)* | 30 g |
| Toluene | 60 g |
| Methyl ethyl ketone | 60 g |
| Dicyclohexyl phthalate | 3 g |
| Diphenyl phthalate | 3 g |
| Surface active polymer | shown in Table 1 |
| Epoxy polyether-modified silicone oil (SF 8421, manufactured by Toray Silicone Co., Ltd.) | 3 g |
| Fatty acid ester (Unistar H-467, manufactured by Daihachi Chemical | 3 g |

-continued

| |
|---|
| Industry Co., Ltd.) |

After Solution IB and Solution IIB were each dissolved well, Solution IIB was added to Solution IB under stirring, and the mixture was emulsified and dispersed with a homogenizer at 15,000 rpm for 9 minutes to thereby prepare the dye-accepting polymer emulsion B.

PREPARATION OF THE THERMAL TRANSFER IMAGE-RECEIVING MATERIAL

The above 1st to 3rd layers were provided on a support prepared by coating both sides of paper having a basis weight of 180 g/m$^2$ with polyethylene containing titanium oxide dispersed therein so that the wet film thicknesses of the 1st to 3rd layers became 20, 60 and 15 ml/m$^2$, respectively, followed by drying, whereby the thermal transfer image-receiving material Samples Nos. 101 to 106 as shown in Table 1 were formed.

The thermal transfer dye-providing material and thermal transfer image-receiving material thus prepared were superposed so that the dye-providing layer and image-receiving layer were contacted with each other, and heat was applied from the support side of the thermal transfer dye-providing material with a thermal head for printing under the output conditions of 0.25 w/dot, a pulse width of 0.15 to 15 msec and a dot density of 6 dots/mm, to thereby imagewise fix the respective dyes on the image-receiving layer of the thermal transfer image-receiving material.

EVALUATION OF THE PROPERTIES

Transfer density

The transfer density of the portion with the pulse width of 15 msec was measured with a reflection type densitometer X-rite-404, manufactured by X-rite Inc. The results are shown in Table 1.

Blur at a high temperature and high humidity

The image-receiving materials were stored at 60° C. and 80% RH for one week after transfer, and the blur of the images was observed, with the results being classified as follows:

A: No blur observed,

B: A little blur observed, and

C: Blur observed to a large extent.

TABLE 1

| Sample No. | Surface Active Polymer Compound | Surface Active Polymer Amount (g) | Transfer Density (Dmax) Cyan | Magenta | Yellow | Blur |
|---|---|---|---|---|---|---|
| 101 (X) | — | — | 1.98 | 2.07 | 2.18 | B |
| 102 (Y) | Polymer (5) | 1.5 | 1.96 | 2.04 | 2.15 | A-B |
| 103 (Y) | Polymer (5) | 3 | 1.94 | 2.03 | 2.14 | A |
| 104 (Y) | Polymer (5) | 4.5 | 1.90 | 2.01 | 2.09 | A |
| 105 (Y) | Polymer (8) | 3 | 1.88 | 2.00 | 2.10 | A |
| 106 (Y) | Polymer (1) | 3 | 1.89 | 1.96 | 2.08 | A |

X: Comparison
Y: Invention

As can be seen from the results shown in Table 1, the prevention of blurring of an image at high humidity was markedly improved by adding the surface active polymers according to the present invention.

EXAMPLE 2

The coating solutions for the 3rd layer of the image-receiving material in Samples No. 101 to 106 prepared in Example 1 were kept in a thermostat at 40° C. for aging while stirring. The solutions were sampled after 30 minutes and 24 hours, and the sampled solutions were coated on a transparent polyethylene terephthalate substrate (100 μm) to a dry thickness of 3 μm. After drying, the transmittance thereof was measured. The results are shown in Table 2.

TABLE 2

| Sample No. | Transmittance (%) After 30 min. | After 24 hrs |
|---|---|---|
| 101 (Comp.) | 72 | 13 |
| 102 (Inv.) | 80 | 71 |
| 103 (Inv:) | 85 | 83 |
| 104 (Inv.) | 87 | 86 |
| 105 (Inv.) | 84 | 80 |
| 106 (Inv.) | 83 | 82 |

It is clearly shown in the results summarized in Table 2 that the coating solutions containing the surface active polymers according to the present invention were very stable, even after storing in a solution, without any significant increase in the size of the particles in the dispersion occurring.

EFFECTS OF THE INVENTION

The stability of the dispersion in which the surface active polymer according to the present invention is used for emulsifying and dispersing the dye-accepting substance has been improved. Furthermore, an image transferred onto an image-receiving material prepared by using the surface active polymer according to the present invention does not blur, even after storing at a high temperature and high humidity.

While the invention has been described in detail and with reference to specific embodiments thereof, it will be apparent to one skilled in the art that various changes and modifications can be made therein without departing from the spirit and scope thereof.

What is claimed is:

1. A thermal transfer image-receiving material comprising a support having provided thereon at least one image-receiving layer for accepting a dye transferred from a thermal transfer dye-providing material to form an image, wherein the image-receiving layer contains a dispersion prepared by dispersing a dye-accepting substance in a hydrophilic binder with an emulsifier comprising at least one surfactant selected from the polymers containing a repetitive unit represented by Formula (I):

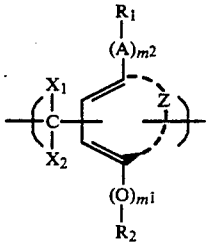

(I)

wherein $R_1$ and $R_2$ may be the same or different and each represent a hydrogen atom, a halogen atom, a substituted or unsubstituted aliphatic hydrocarbon group, or an —$SO_3M$ group, in which M represents a cation capable of forming a salt with sulfonic acid; A represents —O— or —NH—; Z represents a group of carbon atoms necessary for forming a benzene ring or a naphthalene ring; $m^1$ and $m^2$ each represent 0 or 1; and $X_1$ and $X_2$ may be the same or different and each represent a hydrogen atom, a substituted or unsubstituted alkyl group, or a substituted or unsubstituted aryl group, provided that $X_1$ and $X_2$ may be combined with each other to form a 3- to 8-membered ring.

2. A thermal transfer image-receiving material as in claim 1, wherein $X_1$ and $X_2$ are a hydrogen atom, a substituted or unsubstituted alkyl group having 1 to 8 carbon atoms, or a phenyl group.

3. A thermal transfer image-receiving material as in claim 1, wherein said surfactant has a molecular weight of from about 500 to about 10,000.

4. A thermal transfer image-receiving material as in claim 1, wherein said support is a polyolefin-coated paper.

5. A thermal transfer image-receiving material as in claim 1, wherein said dye-accepting substance is a dye-accepting polymer.

6. A thermal transfer image-receiving material as in claim 5, wherein a thermal solvent is present in combination with said dye-accepting polymer.

7. A thermal transfer image-receiving material as in claim 5, wherein said dye-accepting polymer is a polyester resin.

8. A thermal transfer image-receiving material as in claim 1, wherein said image-receiving layer has a total thickness of from 0.5 to 50 μm.

9. A thermal transfer image-receiving material as in claim 8, wherein said image-receiving layer has a total thickness of from 3 to 30 μm.

10. A thermal transfer image-receiving material as in claim 1, wherein said repetitive unit is represented by Formula (I'):

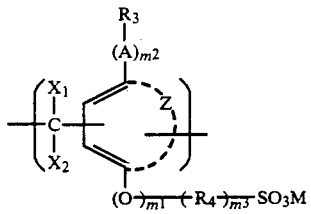

(I')

wherein $R_3$ represents a hydrogen atom or a substituted aliphatic hydrocarbon group; $R_4$ represents a divalent aliphatic hydrocarbon group, provided that this divalent group may contain an oxygen atom; M represents a cation capable of forming a salt with sulfonic acid; A represents —O— or —NH—; Z represents a group of carbon atoms necessary for forming a benzene ring or a naphthalene ring; $m^1$, $m^2$ and $m^3$ each represent 0 or 1; and $X_1$ and $X_2$ may be the same or different and each represent a hydrogen atom, a substituted or unsubstituted alkyl group, or a substituted or unsubstituted aryl group, provided that $X_1$ and $X_2$ may be combined with each other to form a 3- to 8-membered ring.

11. A thermal transfer image-receiving material as in claim 10, wherein $X_1$ and $X_2$ are a hydrogen atom, a substituted or unsubstituted alkyl group having 1 to 8 carbon atoms, or a phenyl group.

12. A thermal transfer image-receiving material as in claim 10, wherein said divalent aliphatic hydrocarbon group represented by $R_4$ is an alkylene group, an alkyleneoxy group, a polyalkyleneoxy group, or an alkyleneoxy-alkylene group.

13. A thermal transfer image-receiving material as in claim 10, wherein said surfactant has a molecular weight of from about 500 to about 10,000.

14. A thermal transfer image-receiving material as in claim 10, wherein said support is a polyolefin-coated paper.

15. A thermal transfer image-receiving material as in claim 10, wherein said dye-accepting substance is a dye-accepting polymer.

16. A thermal transfer image-receiving material as in claim 15, wherein a thermal solvent is present in combination with said dye-accepting polymer.

17. A thermal transfer image-receiving material as in claim 15, wherein said dye-accepting polymer is a polyester resin.

18. A thermal transfer image-receiving material as in claim 10, wherein said image-receiving layer has a total thickness of from 0.5 to 50 μm.

19. A thermal transfer image-receiving material as in claim 18, wherein said image-receiving layer has a total thickness of from 3 to 30 μm.

* * * * *